US006513474B2

(12) United States Patent
Yoon

(10) Patent No.: US 6,513,474 B2
(45) Date of Patent: Feb. 4, 2003

(54) ASSEMBLY TO SECURE ENGINE CAMSHAFT

(75) Inventor: Ji-Min Yoon, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/028,664

(22) Filed: Dec. 28, 2001

(65) Prior Publication Data

US 2002/0185094 A1 Dec. 12, 2002

(30) Foreign Application Priority Data

Jun. 12, 2001 (KR) ..... 2001-0032835

(51) Int. Cl.[7] ..... F01L 1/04
(52) U.S. Cl. ..... 123/90.27; 123/193.5
(58) Field of Search ..... 123/90.27, 90.6, 123/193.5, 193.3

(56) References Cited

U.S. PATENT DOCUMENTS 4,593,657 A * 6/1986 Aoi et al. ..... 123/90.6
5,080,057 A * 1/1992 Batzill et al. ..... 123/193.5
5,121,718 A * 6/1992 Saito ..... 123/90.27
5,123,385 A * 6/1992 Sado et al. ..... 123/193.5
5,213,071 A * 5/1993 Iwata et al. ..... 123/90.27
5,339,778 A * 8/1994 Reckzugel et al. ..... 123/193.5
5,458,099 A * 10/1995 Koller et al. ..... 123/193.5
5,596,958 A * 1/1997 Miller ..... 123/193.5
5,617,818 A * 4/1997 Luders ..... 123/90.27

* cited by examiner

*Primary Examiner*—Weilun Lo
(74) *Attorney, Agent, or Firm*—Antonelli, Terry, Stout & Kraus, LLP

(57) ABSTRACT

An assembly to secure an engine camshaft is provided that includes: a cylinder head provided with a plurality of concave parts into which the camshafts are placed, the concave parts allowing for rotation of the camshafts; and a full cam carrier mounted to the cylinder head over the camshafts and allowing for the rotation of the camshafts, the full cam carrier including a plurality of ribs corresponding to positions of the concave parts and integrally formed to the full cam carrier at predetermined intervals.

2 Claims, 2 Drawing Sheets

ASSEMBLY TO SECURE ENGINE CAMSHAFT

BACKGROUND OF THE INVENTION (a) Field of the Invention

The present invention relates to an assembly to secure a camshaft in an engine.

(b) Description of the Related Art

With reference to FIG. 1 which illustrates the prior art, a pair of camshafts 6 is provided in an upper portion of an engine 2 in a state where the camshafts 6 are substantially adjacent to one another. The camshafts 6 are rotated through their connection to a crankshaft sprocket and a timing belt (not shown), thereby acting to open and close intake and exhaust valves. An air-fuel mixture is supplied to combustion chambers of the engine 2 and undergoes combustion therein.

The resulting force drives pistons of the engine 2, that is, the pistons undergo a reciprocating motion within cylinders of the engine 2. This motion of the pistons rotates the crankshaft sprocket. As a result, a camshaft sprocket is rotated by its connection to the crankshaft sprocket through the timing belt such that the camshafts 6 are, in turn, rotated. With the rotation of the camshafts 6, intake cams and exhaust cams formed on the camshafts 6 operate to open and close the intake valves and exhaust valves, respectively.

A plurality of bearing caps 8 are mounted through bolts 16 directly over the camshafts 6 to secure the same, thereby minimizing vibrations of and the generation of noise by the camshafts 6. However, the securing of the camshafts 6 by the independently operating bearing caps 8 provides an insufficient force to firmly fix the camshafts 6. Accordingly, such a structure is not effective in minimizing the vibrations of the camshafts 6 or in preventing the generation of blow-by gas. In addition, the bearing caps 8 make assembly and disassembly difficult. For example, the bearing caps 8 must be mounted in the correct direction during assembly.

SUMMARY OF THE INVENTION

It is an object of the present invention to provide an assembly to secure camshafts in an engine, in which a significant force is applied by the assembly to fully secure the camshafts, thereby reducing vibrations and noise of the camshaft.

It is another object of the present invention to provide an assembly to secure camshafts in an engine that allows for easy assembly and disassembly of the camshafts.

In a preferred embodiment of the present invention, an assembly to secure engine camshafts comprises: a cylinder head provided with a plurality of concave parts into which the camshafts are placed, the concave parts allowing for rotation of the camshafts; and a full cam carrier mounted to the cylinder head over the camshafts and allowing for the rotation of the camshafts, the full cam carrier including a plurality of ribs corresponding to positions of the concave parts and integrally formed to the full cam carrier at predetermined intervals.

Preferably, the full cam carrier further comprises: a base frame fixedly connected to the cylinder head; a plurality of camshaft bearings mounted on the base frame; and an ignition unit connector formed along a length of the base frame at a longitudinal center thereof and including cavities to which ignition units over each cylinder are connected, wherein the ribs are connected on both sides of the ignition unit connector.

According to another preferred embodiment of the present invention, a width of each rib is wide enough to cover a pair of cams such that a substantial amount of noise of the camshafts can be prevented from leaking out.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will now be described in detail with reference to the accompanying drawing.

Figure 1:
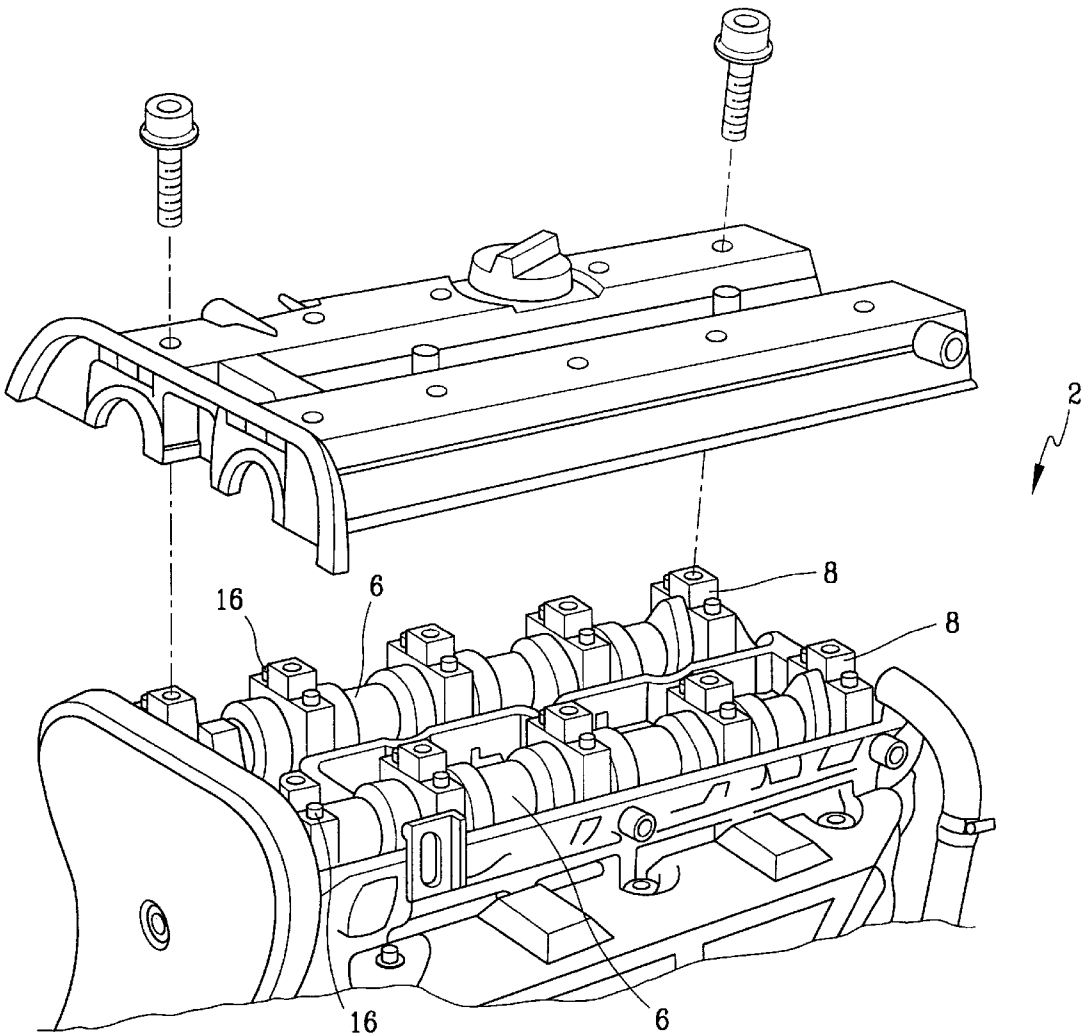
FIG.1 PRIOR ART
FIG. 1 is a partially exploded schematic view of a conventional engine showing camshafts mounted to a cylinder head.
Figure 2:
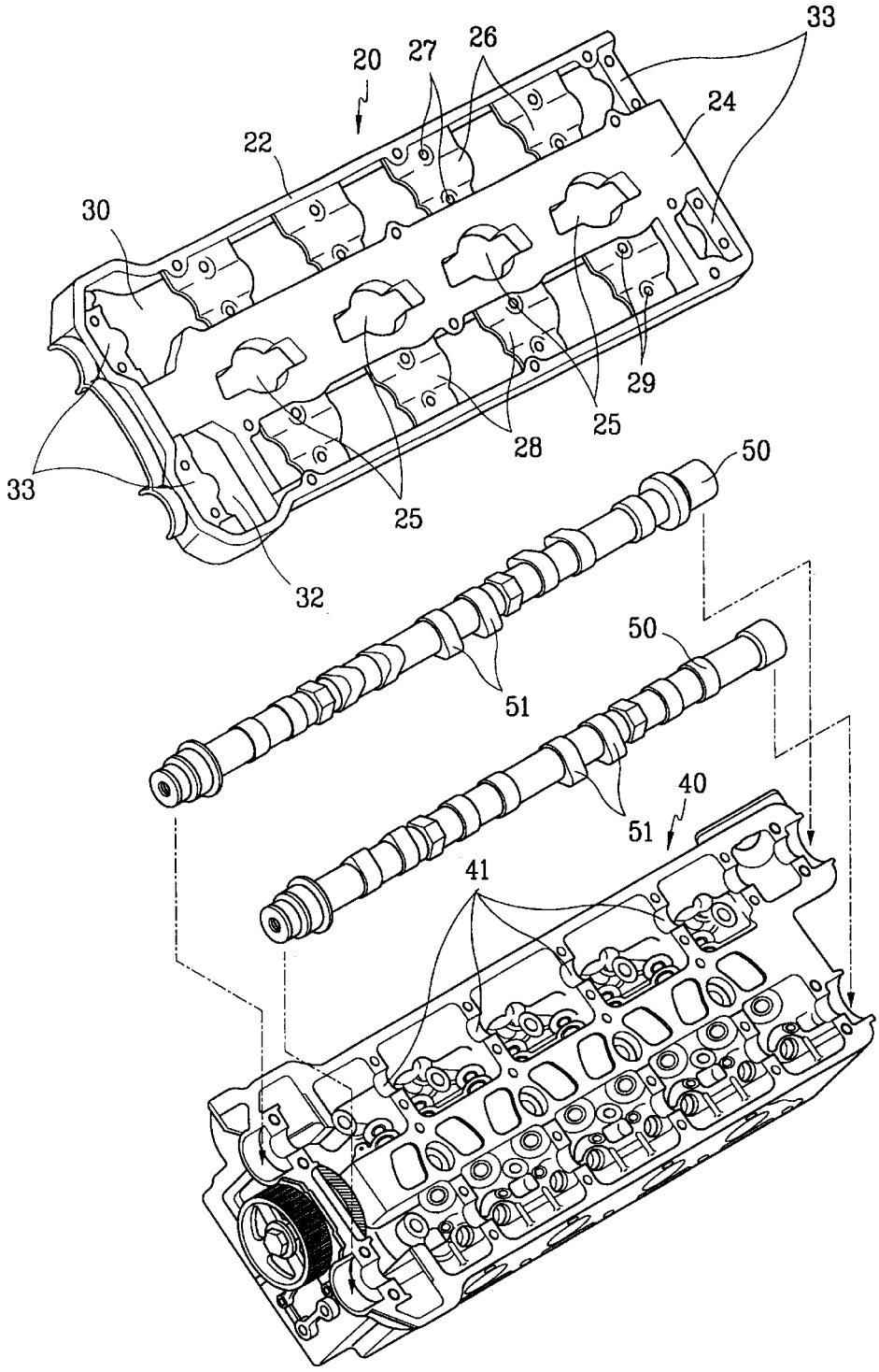
FIG. 2 is a partially exploded schematic view of an engine showing an assembly to secure a camshaft according to a preferred embodiment of the present invention.

FIG. 2 is a partially exploded schematic view of an engine showing an assembly to secure a camshaft according to a preferred embodiment of the present invention.

With reference to the drawing, the assembly to secure a camshaft in an engine includes a cylinder head 40 that is provided with a plurality of concave parts 41, the concave parts 41 allowing for rotation of the camshafts 50; and a full cam carrier 20 mounted to the cylinder head over the camshafts 50. The full cam carrier 20 includes a base frame 22, an ignition unit connector 24, a plurality of ribs 26 and 28, a plurality of camshaft bearing caps 33, and sprocket cavities 30 and 32.

The base frame 22 forms the basic structure of the full cam carrier 20 and is secured to the cylinder head through bolts. The ignition unit connector 24 is formed along a length of the base frame 22 at a longitudinal center thereof. The ignition unit connector 24 includes cavities 25 to which ignition units over each cylinder are connected. As shown in the drawing, the preferred embodiment of the present invention is applied, as an example, to a 4-cylinder double overhead camshaft type engine. There are therefore four cavities 25 formed in the ignition unit connector 24.

The ribs 26 and 28 are integrally formed in the full cam carrier 20 at predetermined intervals, and are provided on both sides of the ignition unit connector 24 corresponding to positions of the camshafts 50 when the full cam carrier 20 is mounted to the cylinder head. Accordingly, each of the ribs 26 and 28 act to cover a pair of cams 51. Preferably, a width of each rib is wide enough to cover a pair of cams 51 such that a substantial amount of noise from the cams can be prevented from escaping. Both holes 27 and 29 are provided in the ribs 26 and 28, respectively. That is, each of the ribs 26 includes a pair of bolt holes 27, which are formed on opposite ends of the ribs 62; and each of the ribs 28 includes a pair of the bolt holes 29, which are formed on opposite ends of the ribs 28. Accordingly, when the full cam carrier 20 is mounted on the cylinder head, the bolt holes 27 of the ribs 26 are provided to both sides of one camshaft 50, and the bolt holes 29 of the ribs 28 are provided to both sides of the other camshaft 50.

The camshaft bearing caps 33 are mounted on the base frame 22 so that they support the camshafts 50 while they are rotating.

The sprocket cavities 30 and 32 are formed in one end of the full cam carrier 20. The sprocket cavities 30 and 32 provide a space to allow for the connection of a camshaft sprocket, which transmits a rotational force received from the engine, to the camshafts 50.

In the assembly to secure an engine camshaft of the present invention described above, with the full cam carrier 20 provided as a single unit that secures the camshafts 50 at predetermined locations over an entire length of the camshafts 50, vibrations and noise generated by the rotation of the camshafts 50 are uniformly absorbed.

Further, the full cam carrier 20 applies a significant force to the camshafts 50 to secure the same. That is, improved performance in reducing NVH (noise, vibration, and harshness) is realized by the full cam carrier 20. NVH performance is improved by approximately 3 dB at 500 Hz or higher when idling, and by roughly 1 dB during acceleration. This ability to firmly fix the camshafts 50 also reduces the generation of blow-by gas.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An assembly to secure engine camshafts comprising:

a cylinder head provided with a plurality of concave parts into which the camshafts are placed, the concave parts allowing for rotation of the camshafts;

a full cam carrier mounted to the cylinder head over the camshafts and allowing for the rotation of the camshafts, the full cam carrier including a plurality of ribs corresponding to positions of the concave parts and integrally formed in the full cam carrier at predetermined intervals;

a base frame fixedly connected to the cylinder head;

at a plurality of camshaft bearing caps mounted on the base frame;

an ignition unit connector formed along a length of the base frame at a longitudinal center thereof and including cavities to which ignition units over each cylinder are connected; and wherein the ribs are connected on both sides of the ignition unit connector and a width of each rib is wide enough to cover a pair of cams such that a substantial amount of noise of the cams can be prevented from escaping.

2. The asembly of claim 1, wherein:

each rib includes a pair of bolt holes, the bolt holes being provided on opposite ends of each rib to which bolts are secured.

* * * * *